US009774967B2

(12) United States Patent
Lavery et al.

(10) Patent No.: US 9,774,967 B2
(45) Date of Patent: Sep. 26, 2017

(54) ACOUSTIC TRANSDUCER AGING COMPENSATION WITH LIFE INDICATOR

(71) Applicant: SYMBOL TECHNOLOGIES, INC., Schaumburg, IL (US)

(72) Inventors: Richard J Lavery, Huntington, NY (US); Sean D Marvel, Hampton Bays, NY (US)

(73) Assignee: Symbol Technologies, LLC, Holtsville, NY (US)

( * ) Notice: Subject to any disclaimer, the term of this patent is extended or adjusted under 35 U.S.C. 154(b) by 144 days.

(21) Appl. No.: 14/465,107

(22) Filed: Aug. 21, 2014

(65) Prior Publication Data

US 2016/0057554 A1 Feb. 25, 2016

(51) Int. Cl.
*H04R 29/00* (2006.01)
*H04R 3/00* (2006.01)

(52) U.S. Cl.
CPC ..... *H04R 29/00* (2013.01); *H04R 3/002* (2013.01)

(58) Field of Classification Search
CPC ..... H04R 2227/003; H04R 2420/07; H04R 27/00; H04R 5/02; H04R 2460/15; H04R 25/453; H04R 29/00; H04R 29/008; H04R 25/30; H04R 25/50; H04R 1/1041; H04R 3/007; H04R 2225/61; H04L 2012/2841;
(Continued)

(56) References Cited

U.S. PATENT DOCUMENTS 6,584,204 B1 * 6/2003 Al-Ali ..... H03G 3/32 381/94.3
7,447,318 B2 11/2008 Button et al.
(Continued)

FOREIGN PATENT DOCUMENTS

AU 2001245740 A1 12/2001
WO 0035247 6/2000
WO 0169968 A2 9/2001

OTHER PUBLICATIONS

International Search Report and Written Opinion mailed Nov. 4, 2015 in counterpart PCT application PCT/2015/042796.
(Continued)

*Primary Examiner* — Lao Lun-See
(74) *Attorney, Agent, or Firm* — Yuri Astvatsaturov

(57) ABSTRACT

Acoustic transducer aging compensation is effective for an acoustic transducer that is driven with an adjustable drive power to output a signal. A microphone can measure the amplitude of the transmitted signal corresponding to a transmitted sound pressure level (SPL). A controller can periodically compare the transmitted SPL to the drive power or a previous SPL, and determine if the received SPL has declined with respect to the input drive power over time, whereupon the controller can direct an increase in drive power to the SPL-declined acoustic transducer to compensate for the decline in received SPL. If drive power is at a maximum, the controller can further instruct a mobile device receiver to lower its receiver detection threshold for the signal from the SPL-declined acoustic transducer to further compensate for the decline in SPL from that acoustic transducer. A life indicator can be provided to inform the system operator of the degraded speaker so as to provide an early warning indicator for servicing of that transducer.

19 Claims, 2 Drawing Sheets

(58) Field of Classification Search
CPC ..... H04L 12/2823; H04L 12/2838; H04L 2012/2849; H04N 21/234327; H04N 21/2662; H04N 1/00132; G10K 11/20; G10L 19/0204; G10L 21/0208; G10L 21/0232; G10L 21/0264
USPC ..... 381/55–59, 397, 111, 116, 96, 77, 79
See application file for complete search history.

(56) References Cited

U.S. PATENT DOCUMENTS

| | | | | |
|---|---|---|---|---|
| 8,401,513 | B2 * | 3/2013 | Langereis | G01S 15/06 367/118 |
| 2007/0025558 | A1 * | 2/2007 | Sakai | H04R 29/003 381/59 |
| 2010/0027807 | A1 * | 2/2010 | Jeon | H03G 7/002 381/74 |
| 2012/0177224 | A1 | 7/2012 | Veneri et al. | |
| 2014/0293747 | A1 * | 10/2014 | Calvarese | G01S 7/52004 367/95 |

OTHER PUBLICATIONS

A.J. Pointon "Piezoelectric Devices" IEEE Proceedings A: Science Measurement & Technology, IEEE vol. 129. No. 5, Jul. 1, 1982.

* cited by examiner

ACOUSTIC TRANSDUCER AGING COMPENSATION WITH LIFE INDICATOR

BACKGROUND

An acoustic transducer or speaker such as an ultrasonic emitter can be used to determine the location of items that contain acoustic microphones such as an ultrasonic receiver. For example, existing devices such as smartphones are capable of receiving ultrasonic signals in order to establish their presence or location within a retail, factory, or warehouse environment. The ultrasonic emitter can transmit ultrasonic energy in a short burst which can be received by an ultrasonic transducer (microphone) in the ultrasonic receiver (e.g. smartphone), thereby establishing the presence of the device within the environment.

Further, the use of several ultrasonic emitters distributed within the environment can also be used to provide a specific location of a particular device using techniques known in the art such as triangulation, trilateration, and the like. However, unlike radio frequency locationing systems, ultrasonic locationing systems suffer from particular problems related to the characteristics of ultrasonic sound waves and their environment of use. For example, ultrasonic signals are easily subject to noise. In particular, broadband noise events (which are typical of impact noise) can fall within the frequency band of interest, and cannot be filtered out without also filtering the desired signal. As a result, accurately triggering a location measurement using an incoming pulse in a flight time based locationing system can be difficult for amplitude based detectors if there are a lot of in-band noise events that could result in false triggers. Detectors of single pulses are very susceptible to impact noise or noise tones greater in length than the pulse period. Moreover, the selectivity of a very short Fast Fourier Transform (FFT) or a Goertzel algorithm run on a single pulse can be poor, i.e. the system is susceptible to tones at nearby frequencies.

Therefore, ultrasonic locationing systems rely on high sound pressure level (SPL) pulses being sent from acoustic transducers in order to overcome the above issues. Using high SPL requires high electrical powers to drive the acoustic transducers to the necessary levels. However, this high intensity burst has been shown to change the characteristics of the transducer during its initial burn-in time in the early stages of its life until it settles into its normal performance. In addition, after its settling time, it has been shown that the transducer's response will continue to decline over time (change its sensitivity, impedance, etc).

Accordingly, there is a need for an improved technique to resolve the above issues with acoustic transducer aging. Furthermore, other desirable features and characteristics of the present invention will become apparent from the subsequent detailed description and the appended claims, taken in conjunction with the accompanying drawings and the foregoing background.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
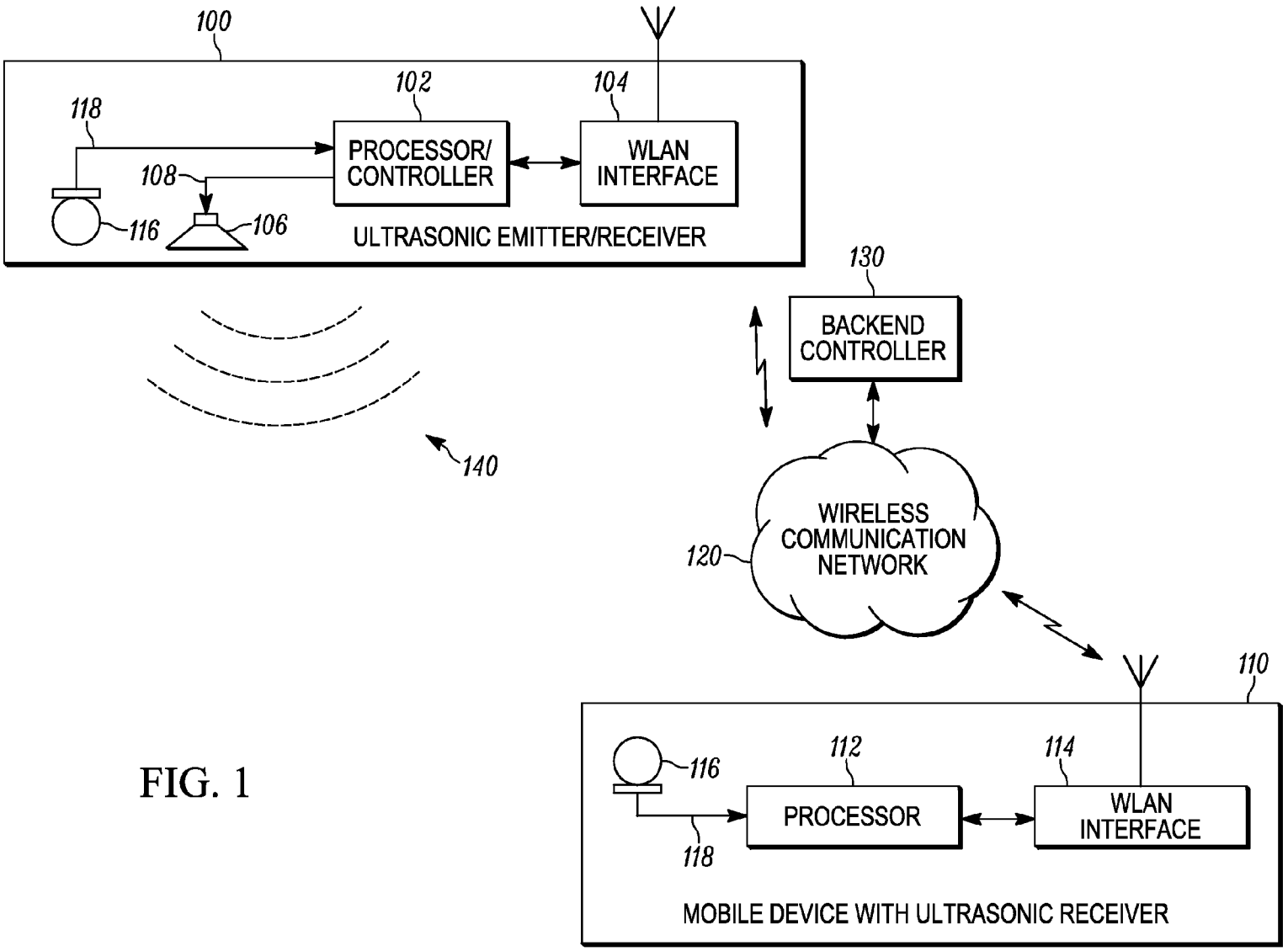
FIG. 1 is a simplified block diagram of a system using an ultrasonic transducer, in accordance with some embodiments of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

According to some embodiments of the present invention, an improved technique is described to resolve the issues with acoustic transducer aging, such as those used for ultrasonic locationing of a device with an ultrasonic receiver within an environment. The present invention resolves this difficulty by detecting the natural changes of acoustic transducers in a system comprising an on board microphone and control logic in a back end controller to drive various compensation mechanisms. The outcome is a means to gauge the existing "life remaining" on each transducer, while maintaining a uniform level of system performance to the point when a service request can be completed. The present invention is not that of a simple feedback loop with a microphone, but rather a detailed system approach to optimize system performance through transducer settling, or burn in, all the way through aging to the point of failure.

The device to be locationed and incorporating the acoustic receiver can include a wide variety of business and consumer electronic platforms such as cellular radio telephones, mobile stations, mobile units, mobile nodes, user equipment, subscriber equipment, subscriber stations, mobile computers, access terminals, remote terminals, terminal equipment, cordless handsets, gaming devices, personal computers, and personal digital assistants, and the like, all referred to herein as a device. Each device comprises a processor that can be further coupled to a keypad, a speaker, a microphone, a display, analog-to-digital converters, analog and digital signal processors, and other features, as are known in the art and therefore not shown.

Various entities are adapted to support the inventive concepts of the embodiments of the present invention. Those skilled in the art will recognize that the drawings herein do not depict all of the equipment necessary for system to operate but only those system components and logical entities particularly relevant to the description of embodiments herein. For example, routers, controllers, switches, access points/ports, and wireless clients can all includes separate communication interfaces, transceivers, memories, and the like, all under control of a processor or controller. In general, components such as processors, transceivers, analog-to-digital converters, digital signal processors, memories, and interfaces are well-known. For example, processing units are known to comprise basic components such as, but not limited to, microprocessors, microcontrollers, memory cache, application-specific integrated circuits, and/or logic circuitry. Such components are typically adapted to implement algorithms and/or protocols that have been expressed using high-level design languages or descriptions, expressed using computer instructions, expressed using messaging logic flow diagrams.

Thus, given an algorithm, a logic flow, a messaging/signaling flow, and/or a protocol specification, those skilled in the art are aware of the many design and development techniques available to implement one or more processors that perform the given logic. Therefore, the entities shown represent a system that has been adapted, in accordance with the description herein, to implement various embodiments of the present invention. Furthermore, those skilled in the art will recognize that aspects of the present invention may be implemented in and across various physical components and none are necessarily limited to single platform implementations. For example, the memory and control aspects of the present invention may be implemented in any of the devices listed above or distributed across such components.

FIG. 1 is a block diagram of an ultrasonic locationing system using an (ultrasonic) acoustic transducer or speaker, in accordance with the present invention. Although an ultrasonic system is demonstrated herein, it should be recognized that the present invention as also applicable to audible systems. In the embodiment described herein, the emitter 100 emits the acoustic signal at a frequency of 19-22 kHz in one ultrasonic frequency burst, although it should be realized that other audible or ultrasonic frequencies could be used. In the embodiment shown, one or more ceiling mounted devices emit an acoustic signal which is used by a mobile device acoustic receiver and/or backend controller to locate the mobile device. However, it should be recognized that the present invention works equally well for one or more acoustic receiver(s) mounted on the ceiling that receive pulses emitted by an acoustic speaker of the mobile device so that the backend controller can locate the mobile device.

As shown, an (ultrasonic) acoustic transducer such as a piezoelectric speaker or emitter 106 can be implemented within a ceiling mounted device 100. The emitter can send an acoustic signal 140 (e.g. a two millisecond frequency burst of ultrasonic sound) within the environment. A controller/processor 102 can also be coupled to a wireless local area network interface 104 for wireless communication with other devices in the communication network 120 such as a backend controller 130 that can control the ultrasonic emitter 100 remotely. Alternatively, the controller/processor 102 could be connected to the communication network 120 through a wired interface connection (not shown), such as an Ethernet interface connection.

The wireless communication network 120 can include local and wide-area wireless networks, wired networks, or other IEEE 802.11 wireless communication systems, including virtual and extended virtual networks. However, it should be recognized that the present invention can also be applied to other wireless communication systems. For example, the description that follows can apply to one or more communication networks that are IEEE 802.xx-based, employing wireless technologies such as IEEE's 802.11, 802.16, or 802.20, modified to implement embodiments of the present invention. The protocols and messaging needed to establish such networks are known in the art and will not be presented here for the sake of brevity.

An ultrasonic receiver 100 or 110 includes a transducer such as an ultrasonic microphone 116 that can respond to the acoustic signal 140 transmitted from the ultrasonic emitter 106. The microphone 116 receives the acoustic signal 140 and converts it to an electrical signal 118 for processing by a processor 102, 112, which can measure an amplitude of the electrical signal 118 that correlates to an amplitude of the emitter acoustic signal 140. The processor 102, 112 can include a receiver circuit including an analog-to-digital converter that converts the signal 118 into a digital waveform that is fed to a digital signal processor (as is known in the art and not shown for the sake of brevity). The digital signal processor functions as a pulse detector that will first run an amplitude based detection algorithm for a band of frequencies of interest, e.g. 19-22 kHz. This detection algorithm could be a Goertzel algorithm, a short FFT, sliding DFT, envelope detection, or any other known technique. The receiver processor 102, 112 can also be coupled to a wireless local area network interface 104, 114 for wireless communication with other devices in the communication network 120. In accordance with the present invention, the ultrasonic receiver used to measure the amplitude of the emitted acoustic signal preferably can be incorporated into the emitting device 100 or could be implemented into another device such as a mobile device 110.

In order to provide locationing ability, using trilateration and/or time-of-arrival techniques for example, the mobile device receiver 110 can receive pulses from a plurality of emitters at known locations within the environment and is able to discriminate between different arrival times of particular ultrasonic pulses. The backend controller can control the transmission timing of the pulses emitted by each emitter. As the location of the emitters 106 is known and fixed, and the pulse transmission times of each emitter are known by the backend controller, a signal received by these emitters can be used to locate and track the position of the mobile receiver device 110 using: time difference of arrival (TDOA) at the microphone, trilateration, multilateration, or other suitable locationing techniques, as are known in the art.

In operation, the present invention provides acoustic transducer aging compensation by first establishing a drive power operating range of the acoustic transducer (i.e. speaker or emitter). The minimum of this range is determined empirically to provide an acoustic signal with an SPL that can just be detected over the noise floor, and the maximum of this range is the maximum SPL designed drive point of the transducer. This operating range can be stored in the backend controller 130 and optionally the emitter controller 102. The backend controller will instruct (through the network 120 and wireless interface 104) the emitter controller 102 to provide a signal 108 to drive the transducer 106 at an initial drive power to output an acoustic signal 140 at a predetermined SPL. The initial power can be a minimum power allowing acceptable operation of the locationing system, which can be determined empirically.

The ultrasonic microphone 116 resident with the ultrasonic emitter 100 (or alternatively the microphone of another device 110) will receive the acoustic signal 140 and measure an amplitude of the acoustic signal that corresponds to a transmitted SPL of the acoustic signal output from the transducer 106, which is then reported back to the backend controller 130 via the wireless interface 104 and network 120. In this way, the backend controller 130 can periodically monitor the transmitted SPL of the acoustic signal output from the transducer and compare this to a given input drive power, in order to determine if the transmitted SPL is declining with respect to the input drive power over time. Alternatively, the backend controller 130 can periodically monitor the transmitted SPL of the acoustic signal output from the transducer and compare this to a previous transmitted SPL, in order to determine if the transmitted SPL is declining over time. During monitoring, the backend controller can also provide an emitter "life indicator" to a system operator so that the system operator can plan maintenance or replacement of the emitter/transducer.

Over time, and due to initial break-in and aging, the emitter output SPL will start to degrade. The backend controller 130 will monitor this SPL degradation and direct the emitter controller 102 to increase electrical drive power 108 to the transducer 106 in order to compensate for the decline in transmitted SPL. The backend controller will also reduce the life indicator accordingly. It is envisioned that the backend controller will increase the electrical drive power to maintain a constant SPL as the transducer degrades with time. This process of monitoring SPL degradation and increasing drive power by the backend controller will continue until the acoustic transducer is no longer able to be compensated and a detected SPL drop ensues. For example, the transducer is being driven at its maximum operating range or at a level where an increase in drive power resulting in no increase in SPL.

Upon reaching this point of diminishing SPL, the backend controller will provide a separate servicing alert, such as a yellow alert for example, to the system operator indicating that the transducer will need servicing soon and SPL is expected to continue its decline. As output SPL continues to decline the backend controller can perform the following additional compensations to maintain performance, in accordance with the present invention.

Since the backend controller is also locating the particular mobile devices with respect to the known locations of the emitters, the backend controller will know if a particular mobile device is within range of a degraded emitter. Therefore, the backend controller can instruct any mobile devices within a transmission area of the affected speaker to lower its receiver detection threshold for acoustic signals from the affected speaker during signal transmission times on that speaker alone. In particular, the amount of the threshold reduction can be set to compensate for the analogous decline in SPL measured from that speaker. This should result in no change in system performance assuming the new detection threshold is not exceeded by the noise floor. In other words, the mobile device has a minimum receiver detection threshold just above the noise floor, where the mobile device can still barely detect the acoustic signal from a particular emitter. The backend controller will also reduce the life indicator accordingly.

Once the backend controller determined that the transducer has reached an SPL below which is considered unusable by the mobile devices, i.e. at the minimum receiver detection threshold, the transducer is turned off and the backend controller will provide a second separate servicing alert, such as a red alert for example, to the system operator indicating that the transducer needs immediate servicing. Before servicing is complete, the loss of this transducer can be incorporated into a system scheduler of the backend controller to change and optimize a transmission schedule of the remaining emitters without it. This will allow the system to turn off the affected emitter and continue to operate the system while waiting for servicing by the system operator. This can include changing the pulse timing and drive levels of each remaining emitter in order to provide extended coverage in the affected area of the SPL-declined acoustic transducer.

Figure 2:
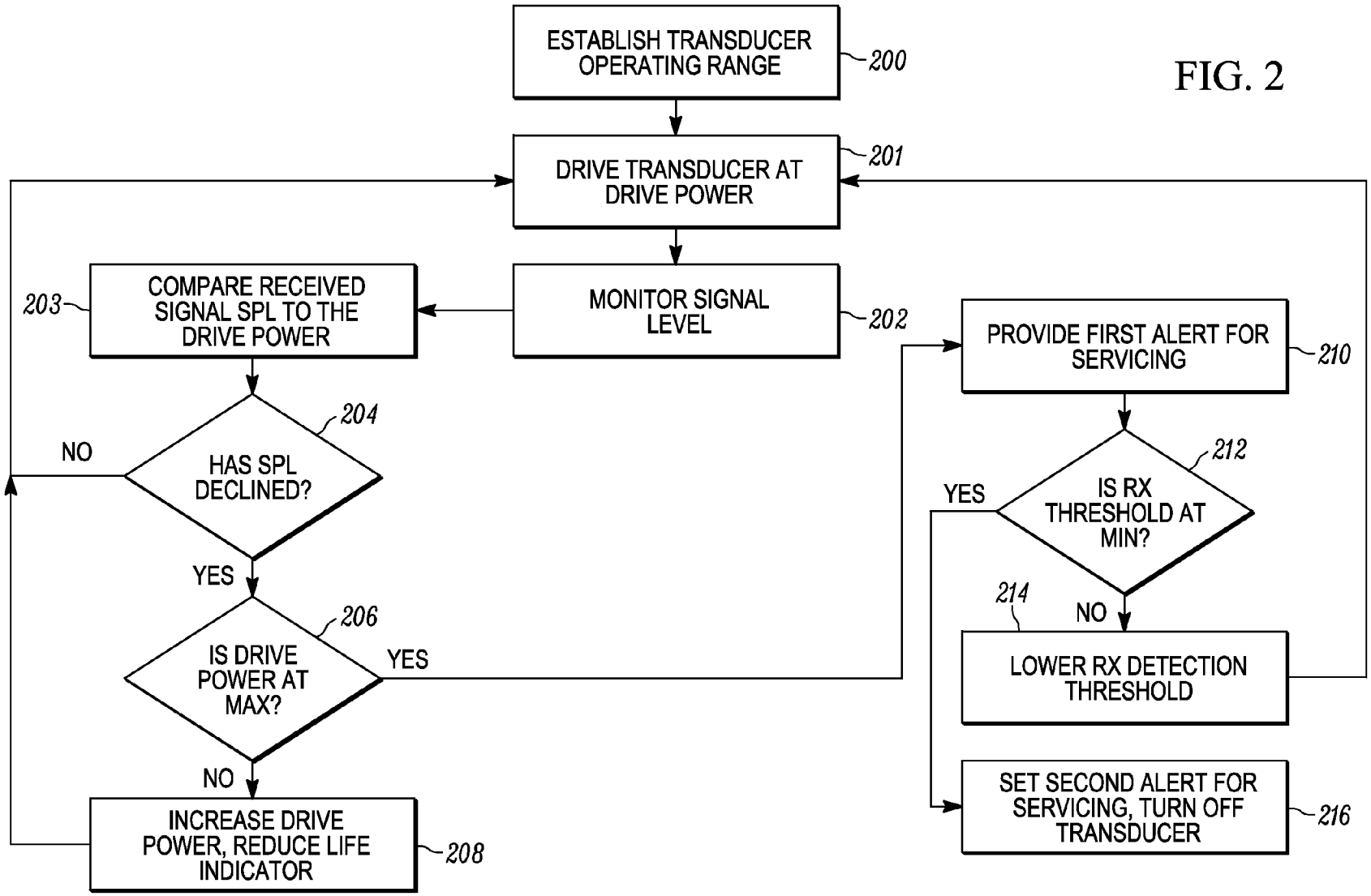
FIG. 2 is a flow diagram illustrating a method, in accordance with some embodiments of the present invention.

FIG. 2 is a diagram illustrating a method for acoustic transducer aging compensation, according to some embodiments of the present invention.

A first step 200 includes establishing a drive power operating range of the acoustic transducer.

A next step 201 includes driving at least one acoustic transducer with an adjustable drive power to output an acoustic signal.

A next step 202 includes monitoring the acoustic signal and measuring an amplitude of the acoustic signal to determine a transmitted sound pressure level (SPL) of the acoustic signal.

A next step 203 includes comparing the received SPL to previous SPL values or alternatively the drive power over time.

A next step 204 includes determining if the received SPL has declined with respect to previous SPL values or alternatively the input drive power over time. If not, returning to the driving step 201.

Otherwise, if the received SPL has declined over time, determining 206 if the acoustic transducer is being driven at a maximum drive power of the operating range or at a level where an increase in drive power resulting in no increase in SPL. If the acoustic transducer is not being driven at a maximum drive power of the operating range, a next step 208 includes directing an increase in drive power to the SPL-declined acoustic transducer to compensate for the decline in received SPL, and returning to the driving step 201. This directing step can include providing a life indicator to a system operator showing the decline in received SPL for the SPL-declined acoustic transducer.

If the acoustic transducer is being driven at a maximum drive power, a next step 210 includes providing a first servicing alert to a system operator indicating that the acoustic transducer will need servicing. In addition, if it is determined 212 that a receiver detection threshold is not at a minimum, instructing 214 the receiver to lower its receiver detection threshold for the acoustic signal from the SPL-declined acoustic transducer if it is within a transmission area of the SPL-declined acoustic transducer only during signal transmission times of that acoustic transducer to compensate for the decline in SPL from that acoustic transducer, and in any case returning to step 201. However, if it is determined 212 that the receiver detection threshold is at a minimum, providing 216 a second servicing alert indicating that the acoustic transducer needs immediate servicing, turning off the SPL-declined acoustic transducer, and changing the transmission schedule of remaining emitters.

Advantageously, the present invention provides a technique for establishing a constant level of performance in an acoustic transducer as the transducer's performance degrades over time. It also provides a system operator with an indication of the remaining life of the transducer so that eventual maintenance can be scheduled in advance of system failure.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors or processing devices such as microprocessors, digital signal processors, customized processors and field programmable gate arrays and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits, in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a compact disc Read Only Memory, an optical storage device, a magnetic storage device, a Read Only Memory, a Programmable Read Only Memory, an Erasable Programmable Read Only Memory, an Electrically Erasable Programmable Read Only Memory, and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and integrated circuits with minimal experimentation.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A system for acoustic transducer aging compensation, comprising:

at least one acoustic transducer operable to be driven with an adjustable drive power to output an acoustic signal;

a receiver with at least one microphone operable to receive the acoustic signal and measure an amplitude of the received acoustic signal corresponding to a transmitted sound pressure level (SPL) of the acoustic signal; and a controller communicatively coupled to the at least one acoustic transducer and receiver, the controller operable to periodically determine when the transmitted SPL has declined over time, whereupon the controller is further operable to direct an increase in drive power to the SPL-declined acoustic transducer to compensate for the decline in received SPL;

wherein the at least one acoustic transducer is an ultrasonic speaker, and wherein the acoustic signal is an ultrasonic frequency burst, and wherein the controller is further operable to: when the SPL-declined acoustic transducer is being driven at a maximum drive power and when detection threshold of a mobile device receiver is not at a minimum, instruct the mobile device receiver to lower the detection threshold for the acoustic signal from the SPL-declined acoustic transducer to compensate for the decline in SPL from the SPL-declined acoustic transducer.

2. The system of claim 1, wherein the controller is operable to compare the transmitted SPL to a previous SPL to determine when the transmitted SPL has declined for a given drive power.

3. The system of claim 1, wherein the controller is operable to compare the transmitted SPL to a given drive power to determine when the transmitted SPL has declined with respect to an input drive power over time.

4. The system of claim 1, wherein the controller is further operable to provide a life indicator to a system operator showing the decline in received SPL for the SPL-declined acoustic transducer.

5. The system of claim 1, wherein the controller is further operable to establish a drive power operating range of the acoustic transducer, and determine when the SPL-declined acoustic transducer is being driven at the maximum drive power, whereupon the controller will provide a first servicing alert to a system operator indicating that the SPL-declined acoustic transducer will need servicing.

6. The system of claim 1, wherein the controller is further operable to, when the SPL-declined acoustic transducer is being driven at the maximum drive power, provide a first servicing alert to a system operator indicating that the SPL-declined acoustic transducer will need servicing.

7. The system of claim 1, wherein the detection threshold is lowered when the mobile device receiver is within a transmission area of the SPL-declined acoustic transducer.

8. The system of claim 1, wherein the detection threshold for the acoustic signal from the SPL-declined acoustic transducer is lowered during signal transmission times of the SPL-declined acoustic transducer.

9. The system of claim 1, wherein the controller is further operable to determine when the detection threshold is at the minimum, whereupon the controller will provide a second servicing alert to a system operator indicating that the acoustic transducer needs immediate servicing.

10. The system of claim 9, wherein the controller is further operable to turn off the SPL-declined acoustic transducer when the detection threshold is at the minimum, and change a transmission schedule of remaining acoustic transducers in the system.

11. A method for acoustic transducer aging compensation, comprising:

driving at least one acoustic transducer with an adjustable drive power to output an acoustic signal;

monitoring the acoustic signal and measuring an amplitude of the acoustic signal to determine a transmitted sound pressure level (SPL) of the acoustic signal;

determining when the transmitted SPL has declined over time; whereupon directing an increase in drive power to the SPL-declined acoustic transducer to compensate for the decline in transmitted SPL; and when the SPL-declined acoustic transducer is being driven at a maximum drive power and when a detection threshold of a mobile device receiver is not at a minimum, instructing the mobile device receiver to lower the detection threshold for the acoustic signal from the SPL-declined acoustic transducer to compensate for the decline in SPL from the SPL-declined acoustic transducer, wherein the acoustic signal is an ultrasonic frequency burst.

12. The method of claim 11, wherein the determining includes comparing the transmitted SPL to the drive power over time.

13. The method of claim 11, wherein the determining includes comparing the transmitted SPL to a previous SPL.

14. The method of claim 11, wherein the directing includes providing a life indicator to a system operator showing the decline in received SPL for the SPL-declined acoustic transducer.

15. The method of claim 11, further comprising:

determining when the SPL-declined acoustic transducer is being driven at a maximum drive power, whereupon providing a first servicing alert to a system operator indicating that the SPL-declined acoustic transducer will need servicing.

16. The method of claim 11, wherein the instructing the mobile device receiver to lower the detection threshold for the acoustic signal from the SPL-declined acoustic transducer occurs when the mobile device receiver is within a transmission area of the SPL-declined acoustic transducer.

17. The method of claim 11, wherein the instructing the mobile device receiver to lower the detection threshold for the acoustic signal from the SPL-declined acoustic transducer occurs during signal transmission times of the SPL-declined acoustic transducer.

18. The method of claim 16, further comprising:

determining when the detection threshold is at the minimum, whereupon providing a second servicing alert to a system operator indicating that the SPL-declined acoustic transducer needs immediate servicing.

19. The method of claim 18, wherein providing a second servicing alert includes turning off the SPL-declined acoustic transducer, and changing a transmission schedule of remaining acoustic transducers.

* * * * *